US007997955B2

(12) United States Patent
Harmat

(10) Patent No.: US 7,997,955 B2
(45) Date of Patent: Aug. 16, 2011

(54) METHOD AND APPARATUS FOR CIRCUMFERENTIAL INTERIOR TREATMENT OF PIPE ELBOWS

(75) Inventor: Fred Harmat, Edmonton (CA)

(73) Assignee: Bradken Canada Ltd, Edmonton (CA)

( * ) Notice: Subject to any disclaimer, the term of this patent is extended or adjusted under 35 U.S.C. 154(b) by 363 days.

(21) Appl. No.: 12/180,385

(22) Filed: Jul. 25, 2008

(65) Prior Publication Data

US 2009/0042491 A1 Feb. 12, 2009

(30) Foreign Application Priority Data

Jul. 26, 2007 (CA) ..... 2595613

(51) Int. Cl.
*B24B 51/00* (2006.01)

(52) U.S. Cl. ..... 451/11; 451/21

(58) Field of Classification Search ..... 451/11, 451/5, 21, 61, 76; 228/254, 38, 44.5, 44.3; 118/75; 427/230
See application file for complete search history.

(56) References Cited

U.S. PATENT DOCUMENTS

| | | | | |
|---|---|---|---|---|
| 2,585,345 | A | 2/1952 | Procos | |
| 3,020,388 | A | 2/1962 | Elliott | |
| 3,388,505 | A * | 6/1968 | Dreiling | 451/180 |
| 3,585,345 | A | 6/1971 | Jespersen | |
| 3,858,026 | A | 12/1974 | Edwards | |
| 4,134,607 | A | 1/1979 | Koski | |
| 4,629,109 | A | 12/1986 | Matsushita | |
| 4,948,027 | A | 8/1990 | Yamashita | |
| 5,539,177 | A | 7/1996 | Okuya | |
| 6,234,383 | B1 * | 5/2001 | Harmat et al. | 228/254 |
| 2010/0187287 | A1 * | 7/2010 | Greenwall | 228/45 |

FOREIGN PATENT DOCUMENTS

| | | |
|---|---|---|
| AU | 6975400 A | 4/2001 |
| CA | 2 282 134 A1 | 3/2001 |
| DE | 33 41 655 A1 | 5/1985 |
| WO | 01/19562 A1 | 3/2001 |

OTHER PUBLICATIONS

"Brospec: Fusionbond® Plate and Pipe," Brospec Inc., Howick, Quebec, Canada, 12-page product brochure, published prior to Sep. 14, 1999.

"CF Ultra Tech Abrasion Resistant Piping Systems," CF Ultra Tech Inc., Grafton, Wisconsin, 4-page product brochure, published prior to Sep. 14, 1999.

"Indulay® Abrasion Resistant Chromium Carbide Welded Overlay for Piping Products," Indutech Industrial Technology, Indutech Canada Limited, Calgary, Alberta, Canada, 4-page product brochure, published prior to Sep. 14, 1999.

* cited by examiner

*Primary Examiner* — Robert Rose
(74) *Attorney, Agent, or Firm* — Husch Blackwell LLP

(57) ABSTRACT

A method for the circumferential interior treatment of pipe elbows, including a step of positioning a working member within a pipe elbow and moving the working member along a portion of a length of the pipe elbow between selected working positions, while concurrently manipulating the pitch and rotational positioning of the pipe elbow to maintain a concentric rotation of the pipe elbow about the working member.

3 Claims, 6 Drawing Sheets

METHOD AND APPARATUS FOR CIRCUMFERENTIAL INTERIOR TREATMENT OF PIPE ELBOWS

FIELD

The present invention relates to a method for circumferential interior treatment of pipe elbows, applicable to welding, grinding, polishing, and spray coating applications, and an apparatus developed in accordance with the method.

BACKGROUND

U.S. Pat. No. 6,234,383, entitled "Method and apparatus for circumferential application of materials to an interior surface of a curved pipe" discloses an earlier version of apparatus.

SUMMARY

There is provided a method for the circumferential interior treatment of pipe elbows, including a step of positioning a working member within a pipe elbow and moving the working member along a portion of a length of the pipe elbow between selected working positions, while concurrently manipulating the pitch and rotational positioning of the pipe elbow to maintain a concentric rotation of the pipe elbow about the working member.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
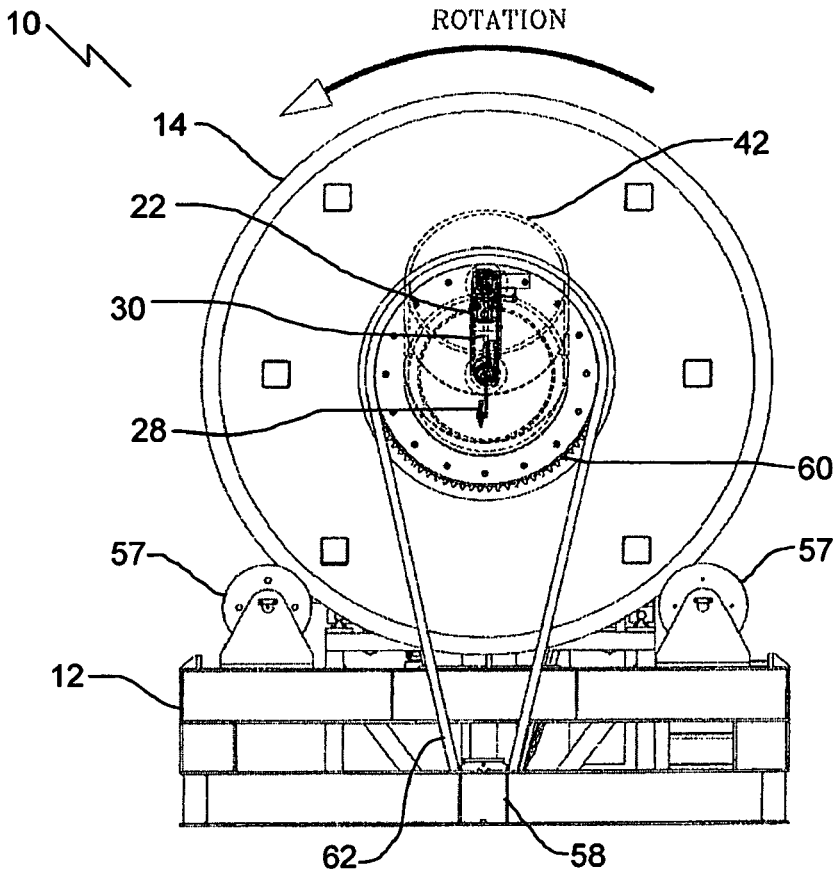
FIG. 1 is a transparent end elevation view of an apparatus for the circumferential interior treatment of pipe elbows.

An apparatus for the circumferential interior treatment of pipe elbows generally identified by reference numeral 10, will now be described with reference to FIG. 1 through 12.

Figure 2:
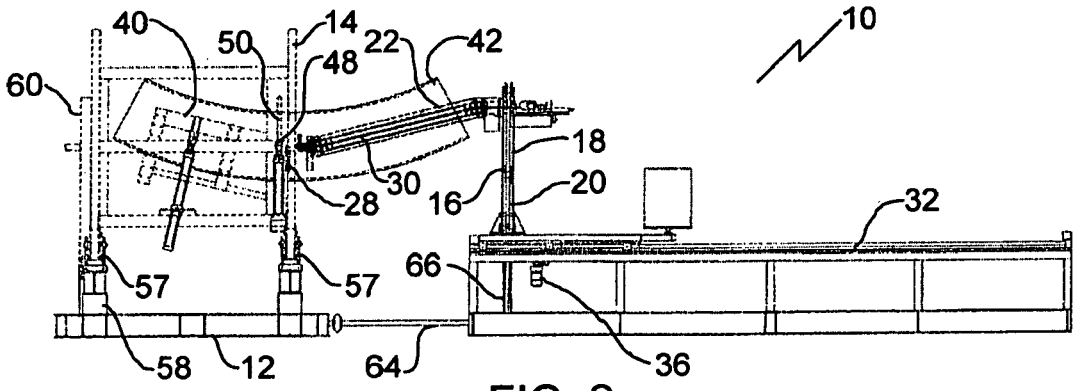
FIG. 2 is a transparent side elevation view of the apparatus in FIG. 1.
Figure 3:
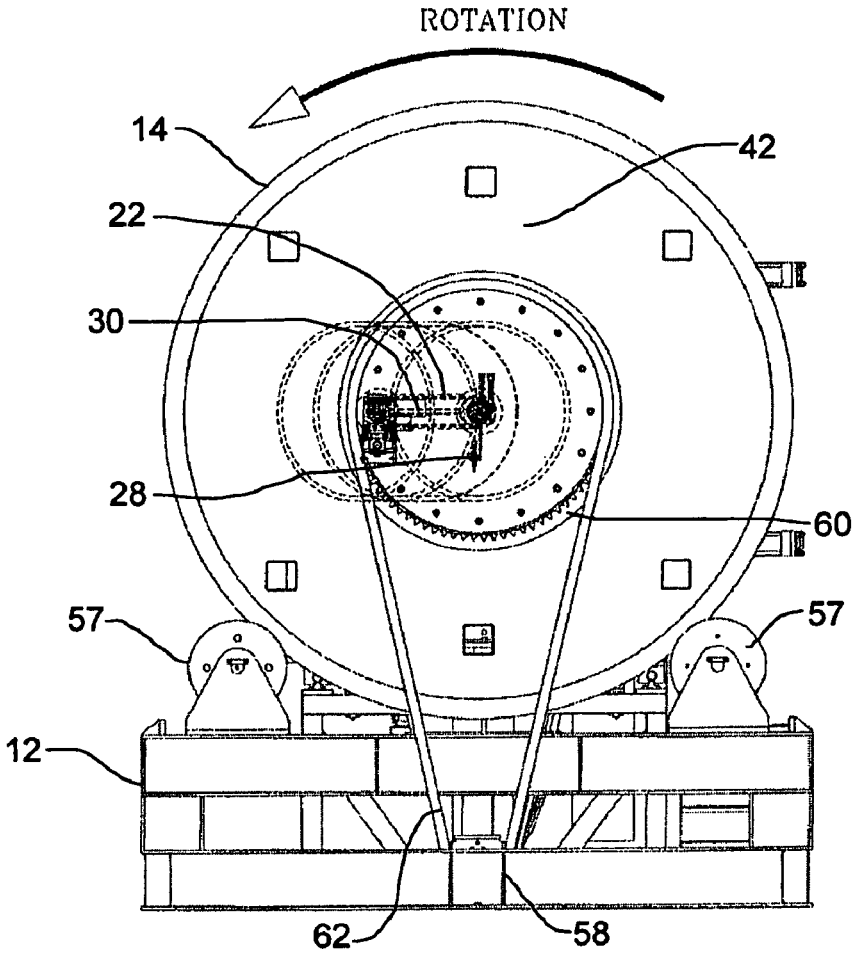
FIG. 3 is a transparent end elevation view of the apparatus in FIG. 1 with the pipe support and arm rotated 90°.
Figure 4:
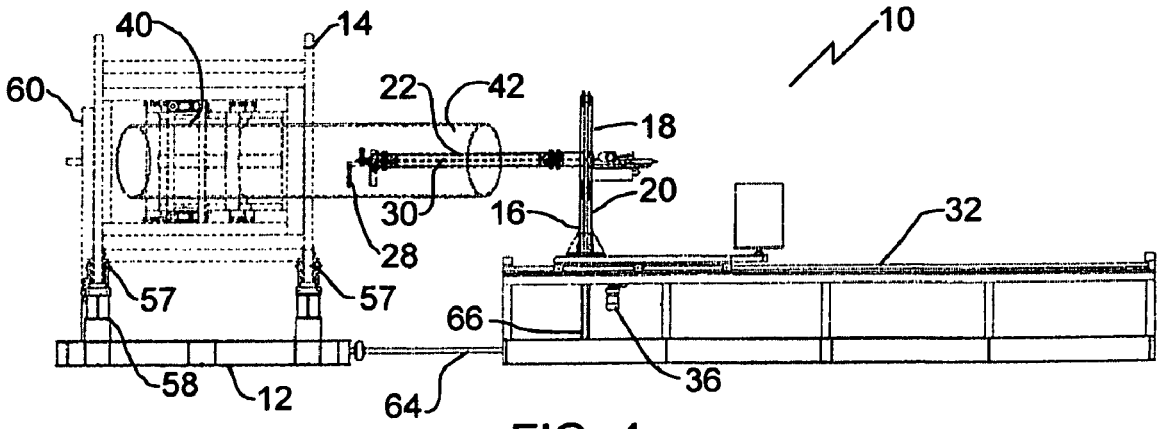
FIG. 4 is a side elevation view of the apparatus in FIG. 1 with the pipe support and arm rotated 90°.
Figure 5:
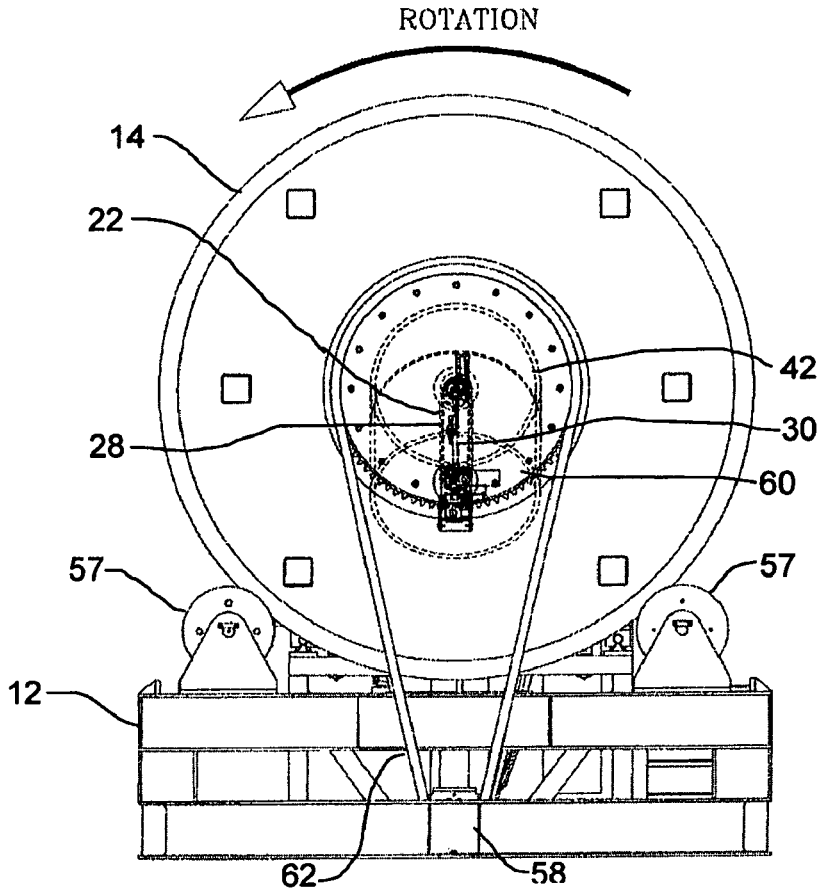
FIG. 5 is a transparent end elevation view of the apparatus in FIG. 1 with the pipe support and arm rotated 180°.
Figure 6:
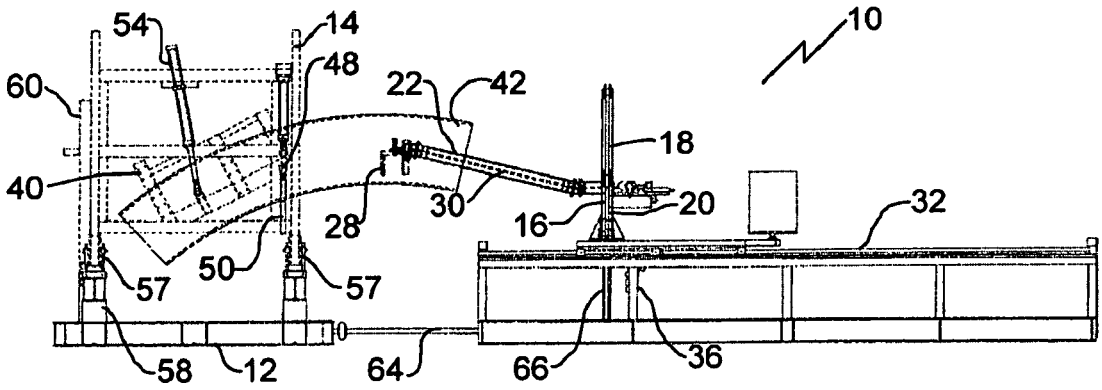
FIG. 6 is a partially transparent side elevation view of the apparatus in FIG. 1 with the pipe support and arm rotated 180°.
Figure 7:
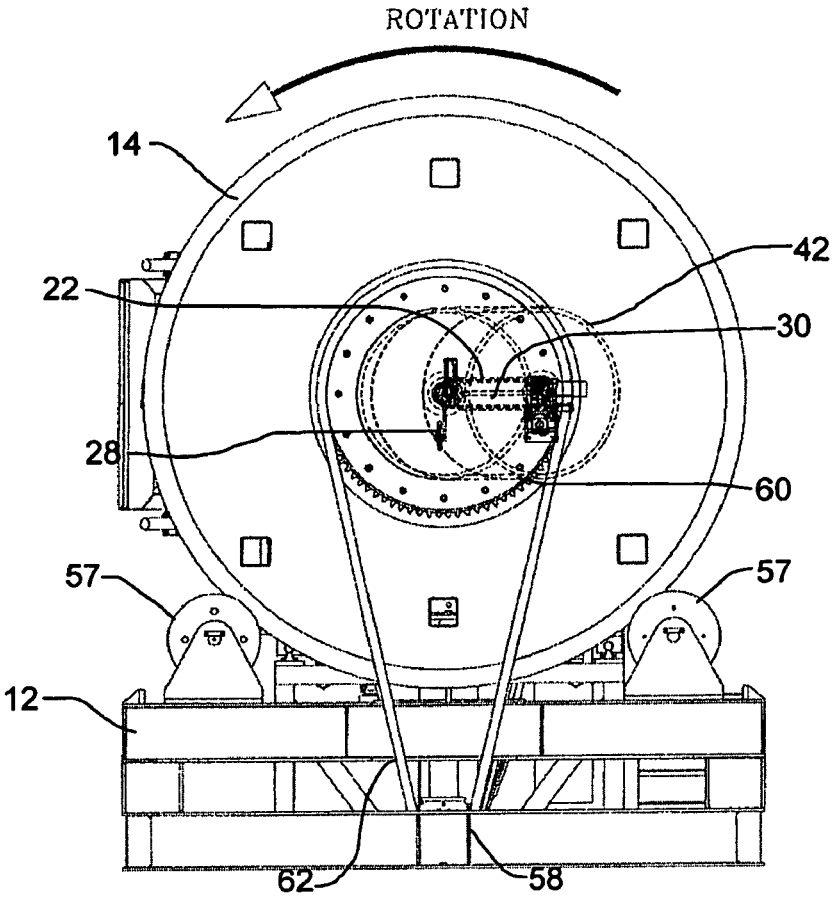
FIG. 7 is a transparent end elevation view of the apparatus in FIG. 1 with the pipe support and arm rotated 270°.
Figure 8:
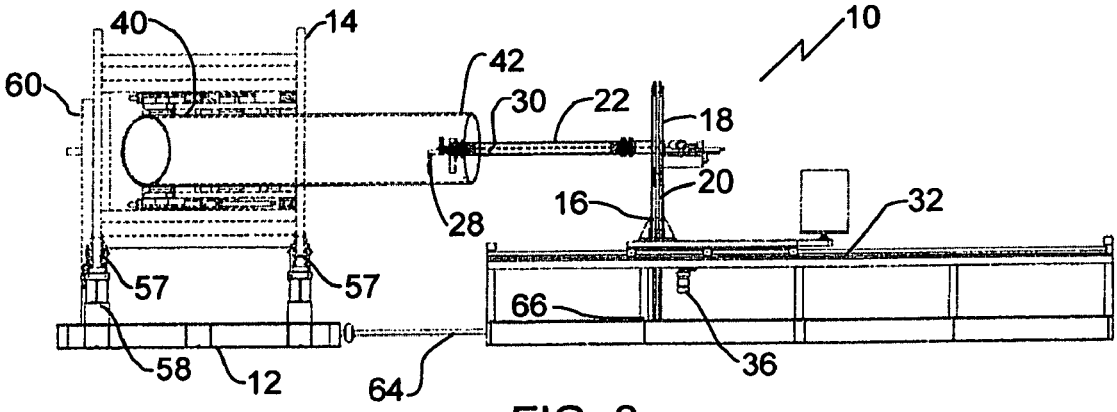
FIG. 8 is a side elevation view of the apparatus in FIG. 1 with the pipe support and arm rotated 270°.
Figure 9:
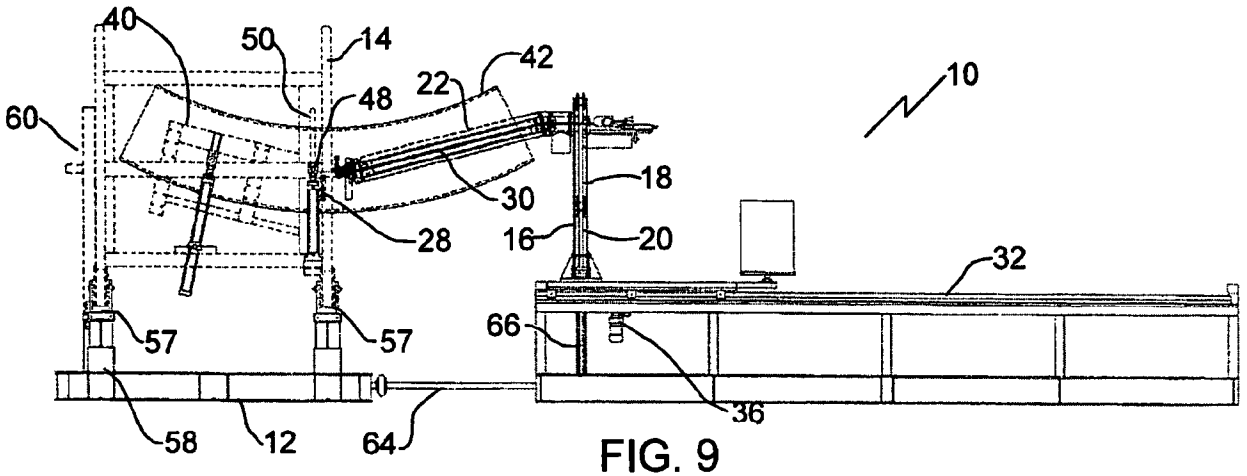
FIG. 9 through 12 are a series of transparent side elevation view of the apparatus in FIG. 1 showing the workpiece being withdrawn.
Figure 10:
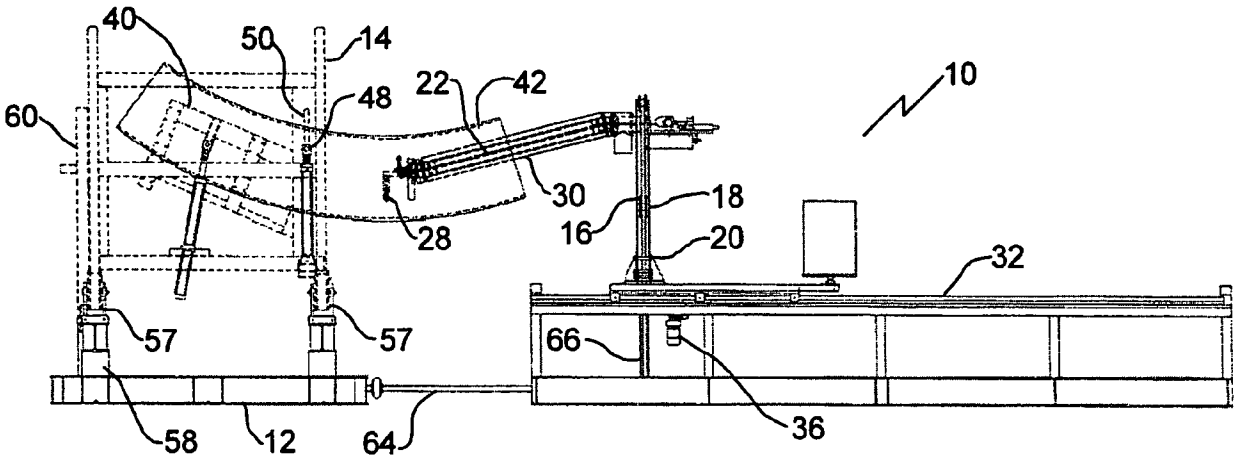
Figure 11:
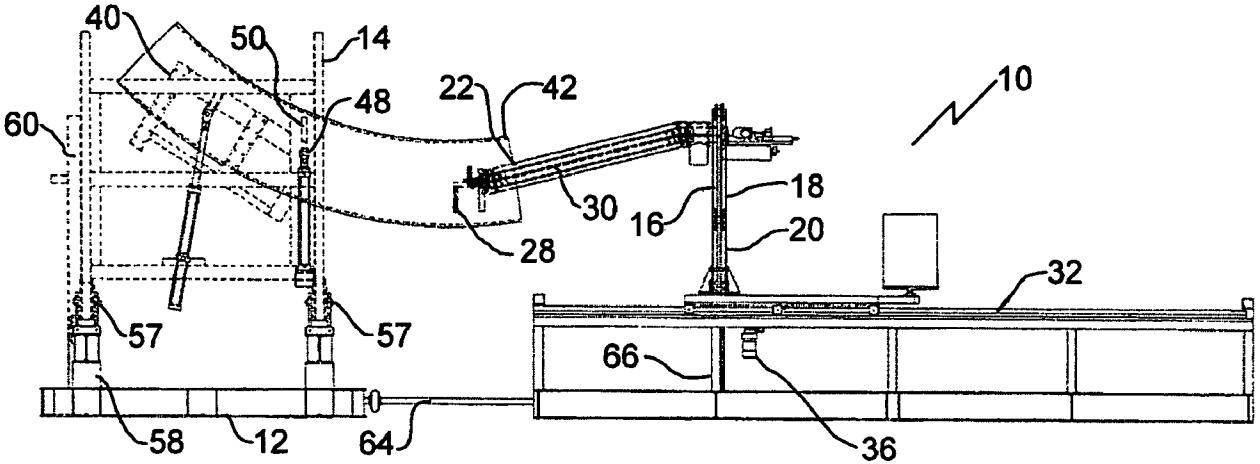
Figure 12:
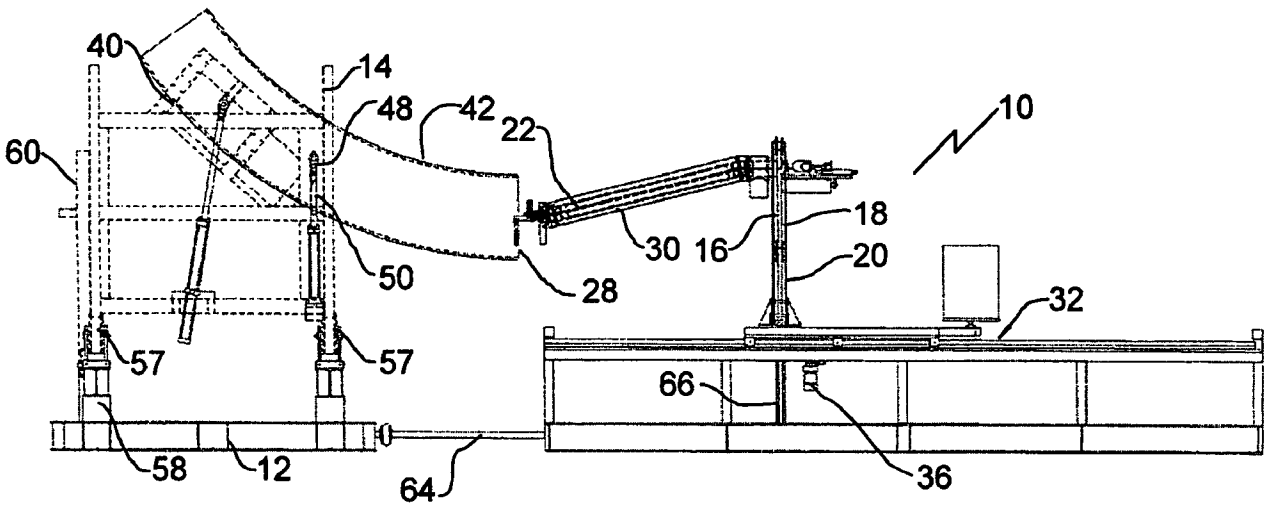

Structure and Relationship of Parts:

Referring to FIG. 9, apparatus 10 includes a base 12, a pipe support 14 mounted for rotation on base 12 about a rotational axis 15, and an arm support 16. Arm support 16 is movable toward and away from pipe support 14, and has a rotatable portion 18 and a fixed portion 20. Rotatable portion 18 rotates about an axis 19. An arm 22 has a mounting end 24 25 and a working end 26. Mounting end 24 of arm 22 is mounted at an angle to rotatable portion 18 of arm support 16. Arm 22 rotates with rotatable portion 18 of arm support 16. FIGS. 1 and 2 shows arm 22 and a pipe elbow 42 in an upright, starting position; FIGS. 3 and 4 shows arm 22 and pipe elbow 42 rotated 900; FIGS. 5 and 6 shows arm 22 and pipe elbow 42 rotated 180°;, and FIGS. 7 and 8 shows arm 22 and pipe elbow 42 rotated 270°. Referring to FIG. 9, there is a working member 28 positioned at a working end 26 of arm 22. The working member 28 is pivotally mounted to working end 26 such that, referring to FIG. 1 through 8, working member 28 is maintained in a vertical position pointing downward as arm 22 rotates. As can be seen, the angle of arm 22 is chosen such that working member 28 maintains the desired height as arm 22 rotates. A linkage 30 extends through arm 22 and connects to working member 28. Linkage 30 moves with rotatable portion 18 while maintaining a constant orientation. Thus, as arm 22 rotates, the proper orientation and height of working member 28 is maintained. It will be recognized that, while a substantially constant height and orientation is maintained, some movement of working member 28 may be preferred in some circumstances. For example, when used in a welding application, it may be desired to have working member 28 oscillate.

There are different ways of extending working end 26 of arm 22 into pipe support 14 and between selected working positions. In the embodiment illustrated in FIG. 9 through 12, arm supports 16 are mounted to tracks 32. A motor 36 is provided, which applies the force to move arm support 16 in either direction. Arm support 16 is connected to tracks 32 either directly or by a support frame 38 as shown. FIG. 9 through 12 show arm support moving progressively away from pipe support 14 at different stages of the treatment.

There is a pipe receiver 40 positioned within pipe support 14 that rocks to control the pitch of a pipe elbow 42 supported by pipe support 14. This is done to maintain a concentric rotation of pipe elbow 42 about working end 26 of arm 22 where working member 28 is located. Pipe receiver 40 has a first end 44 and a second end 46. First end 44 has outwardly projecting pins 48 which travel along slots 50 in pipe support 14. As shown, front pistons 52 and rear pistons 54 are used to raise and lower first end 44 and second end 46 of pipe receiver 40, respectively, to control the pitch of pipe receiver 40 and therefore pipe elbow 42. Other power sources may be used to provide the vertical control of pipe support 14. As first end 44 and second end 46 of pipe receiver 40 are raised and lowered, pins 48 at first end 44 of pipe receiver 40 travel along the slots 50 to maintain the proper lateral position of pipe receiver 40.

Referring to FIG. 1, pipe support 14 is rotatably supported on base 12 by trunnion wheels 57 at the front and back and on each side. Since timing is important, pipe support 14 is rotated by a positive drive. As shown, the positive drive includes a motor 58 that is connected by a drive chain 62 to an engagement wheel 60 of pipe support 14. Other positive drives will be apparent to those skilled in the art, such as a gear drive. As motor 58 applies a force to chain 62, engagement wheel 60 is rotated, which in turn rotates pipe support 14 and pipe receiver 40 through the positions shown in FIG. 1 through 8. Referring to FIG. 9, motor 58 also controls the rotation of rotatable portion 18 of arm support 16 by driving a drive shaft 64, which is in turn connected to a drive chain 66. In this way, the rotation of both pipe support 14 and rotatable portion 18 are synchronized.

Operation:

The use and operation of apparatus 10 will now be described. Referring to FIG. 9, pipe elbow 42 is mounted in pipe receiver 40 which is supported by pipe support 14. Pistons 52 and 54 are used to adjust pipe receiver 40 to obtain the desired starting position, and arm support 16 is advanced along tracks 32 using motor 36 to position working member 28 carried by arm 22 within pipe elbow 42. In one example, the process is started with working member 28 positioned halfway into pipe elbow 42. Once working member 28 has reached the end of pipe elbow 42, it may then be reversed to treat the other half of pipe elbow 42. Referring to FIGS. 1, 3, 5 and 7, motor 58 causes engagement wheel 60 to rotate via chain 62 in order to rotate pipe support 14 and therefore pipe elbow 42. As pipe elbow 42 is being rotated through a full circle, referring to FIGS. 2, 4, 6 and 8, motor 58 also rotates a drive shaft 64 which in turn rotates rotatable portion 18 of arm support 16 such that arm 22 rotates at the same rate as pipe elbow 42. However, during rotation through these positions, it will be noted that working member 28 maintains its initial orientation and position. Referring to FIG. 9 through 12, as pipe elbow 42 is being rotated and treated as described above, arm support 16 and therefore working member 28 is repositioned by motor 36 while pistons 52 and 54 adjust the pitch of pipe receiver 40 and therefore pipe elbow 42. Pins 48 in slots 50 maintain the lateral position of pipe receiver 40. The process described and depicted allows the user to treat the inside of pipe elbow 42 using a helical pattern. The pitch of the helix may be adjusted based on the preferences of the user. It will also recognized that apparatus 10 may treat pipe elbows 42 using different patterns, such as in bands. In any event, the portion of pipe elbow 42 being treated is properly positioned such that it is centred about rotational axis 14 to ensure that the distance between working member 28 and the inside of pipe elbow 42 is constant during rotation. Once the first half of pipe elbow 42 has been treated, pipe elbow 42 is removed from pipe receiver 40, reversed, and replaced such that the other half of pipe elbow 42 may be treated. As pipe elbow 42 rotates, it may be useful to have motor 58 adjust its speed to have a more consistent treatment along the inside of pipe elbow 42. Since working member 28 applies a treatment, such as a weld, at a constant rate, it may be necessary to accelerate the rotation of pipe elbow 28 while the "short" portion of the bend is being treated, and to slow the rotation of pipe elbow 28 while the "long" portion of the bend is being treated to ensure it is treated evenly. It will also be recognized that, while FIG. 1 through 7 depicts working member 28 treating pipe elbow 42 from the centre outward to the end of pipe elbow 42, apparatus 10 could also be operated such that arm support 16 moves working member 28 from the end toward the centre of pipe elbow 42. Furthermore, in some circumstances, it may be possible to treat the entire inside of pipe elbow 42 without having to have it removed and reversed.

Advantages:

The apparatus described in U.S. Pat. No. 6,234,383, moved the pipe elbow along tracks. This required tracks for every size of pipe and every radius. The method and apparatus described above eliminates the need for tracks, as the pipe elbow remains in a constant axial position while the working head moves. This change in movement enables the pipe elbow to be serviced from either end. When working on an elbow, a sufficient portion such as half can be treated from one end and then the elbow can be reversed in the pipe support and the remaining portion can be treated from the other end. The method and apparatus were developed for use in welding, but can potentially be used for numerous other operations, such as grinding, polishing, and coating application.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the claims.

What is claimed is:

1. An apparatus for the circumferential interior treatment of pipe elbows, comprising:

a base;

a pipe support mounted for rotation on the base about a rotational axis;

an arm support;

an arm having a mounting end and a working end, the mounting end being mounted to the arm support;

means for extending the working end of the arm into the pipe support and moving the working end of the arm between selected working positions;

a working member positioned at the working end of the arm; and a pipe receiver positioned within the pipe support which rocks to control pitch of a pipe elbow supported by the pipe support to maintain a concentric rotation of the pipe elbow about the working end of the arm where the working member is located, wherein the pipe receiver has a first end, a second end, and outwardly projecting pins which travel along slots in the pipe support, means being provided to raise and lower the first end and the second end of the pipe receiver as the pins travel along the slots.

2. An apparatus for the circumferential interior treatment of pipe elbows, comprising:

a base;

a pipe support mounted for rotation on the base about a rotational axis;

an arm support, wherein the arm support is movable toward and away from the pipe support;

an arm having a mounting end and a working end, the mounting end being mounted to the arm support such that the arm is mounted to the arm support at an angle;

means for extending the working end of the arm into the pipe support and moving the working end of the arm between selected working positions, the means for extending the working end of the arm into the pipe support being to move the arm support toward the pipe support a working member positioned at the working end of the arm; and a pipe receiver positioned within the pipe support which rocks to control pitch of a pipe elbow supported by the pipe support to maintain a concentric rotation of the pipe elbow about the working end of the arm where the working member is located, wherein the pipe receiver has a first end, a second end, and outwardly projecting pins which travel along slots in the pipe support, means being provided to raise and lower the first end and the second end of the pipe receiver as the pins travel along the slots.

3. An apparatus for the circumferential interior treatment of pipe elbows, comprising:

a base;

a pipe support mounted for rotation on the base about a rotational axis;

an arm support, wherein the arm support is movable toward and away from the pipe support, the arm support having a rotatable portion and a fixed portion;

an arm having a mounting end and a working end, the mounting end being mounted to the arm support such that the arm is mounted to the arm support at an angle, the mounting end of the arm being mounted to the rotatable portion, such that the arm rotates with the rotatable portion of the arm support;

tracks for extending the working end of the arm into the pipe support and moving the working end of the arm between selected working positions, the arm supports being mounted to the tracks;

a working member positioned at the working end of the arm, the working member being pivotally mounted to the working end of the arm, means being provided to maintain the working member in a vertical position pointing downward as the arm rotates; and a pipe receiver positioned within the pipe support which rocks to control pitch of a pipe elbow supported by the pipe support to maintain a concentric rotation of the pipe elbow about the working end of the arm where the working member is located, the pipe receiver having a first end, a second end, and outwardly projecting pins which travel along slots in the pipe support, means being provided to raise and lower the first end and the second end of the pipe receiver as the pins travel along the slots.

* * * * *